United States Patent [19]

Ruegger

[11] 4,193,555

[45] Mar. 18, 1980

[54] ROLL MILL FOR FEEDING MATERIAL TO THE ROLL GAP

[75] Inventor: Edgar Ruegger, Arnegg, Switzerland

[73] Assignee: Gebruder Buhler AG, Uzwil, Switzerland

[21] Appl. No.: 917,315

[22] Filed: Jun. 19, 1978

[30] Foreign Application Priority Data

Jun. 24, 1977 [CH] Switzerland ..... 7766/77

[51] Int. Cl.[2] ..... B02C 4/02

[52] U.S. Cl. ..... 241/37; 241/224; 241/226; 241/227

[58] Field of Search ..... 222/281, 410; 425/224, 425/363; 241/222, 226, 227, 245, 6, 30, 36, 37, 285 R, 285 A, 230, 231, 234, 224, 225

[56] References Cited

U.S. PATENT DOCUMENTS

| | | | |
|---|---|---|---|
| 1,050,183 | 1/1913 | Wall | 241/226 |
| 2,808,215 | 10/1957 | Bosshard | 241/226 |
| 2,984,423 | 5/1961 | Roth | 241/222 X |

FOREIGN PATENT DOCUMENTS 100694 8/1923 Switzerland .

1080108 8/1967 United Kingdom .

*Primary Examiner*—Mark Rosenbaum

*Attorney, Agent, or Firm*—Merchant & Gould

[57] ABSTRACT

A roll mill has sealing devices pressed against the ends of the rolls to seal the roll gap so that material being processed is not squeezed out (such as oil seed during treatment for flaking). The sealing devices include flow guides (such as recesses therein). A curtain of material, wider than the rolls are long, falls onto the roll gap, and so much of it as exceeds the width of the rolls is guided by the flow guides into the roll gap from beyond the ends of the rolls outwardly of the roll ends. This happens because the flow guides themselves extend near the roll gap but stop short of the roll ends. The sealing devices may include a sealing pin surmounted by an elongate wedge member, the two having communicating recesses which together form the flow guide. The mill may have provision for hydraulically pressing the rolls towards each other during flow of material and separating them while such flow is absent; a hydraulic connection then presses the sealing pins towards the roll ends while the rolls are compressed and lifts them away from the roll ends while the rolls are separated.

9 Claims, 5 Drawing Figures

ROLL MILL FOR FEEDING MATERIAL TO THE ROLL GAP

FIELD OF THE INVENTION

The invention relates to a roll mill for feeding material to the rolls, for use particularly though not exclusively in the flaking of oil seed.

BACKGROUND TO THE INVENTION

Roll mills having two rolls to serve as rolling tools pressed towards one another during operation, with a nip or gap formed between the rolls, into which a stream of material or product to be processed is fed have been known for a long time. The stream of product is introduced into the gap substantially vertically from above, passes through the gap and is thereby comminuted or subjected to flaking depending on the intended use.

A roll mill of this kind such as disclosed for example in Swiss Pat. No. 100694 usually comprises, at the two sides of the rolls, sealing devices which are pressed against the end surfaces of the rolls and laterally seal the gap between the rolls and the space through which the product flows, so that the product is not squeezed out because of the action of the pressure of the rolls.

The object of the invention is to provide an improved roll mill for feeding material to the rolls.

BRIEF DESCRIPTION OF THE INVENTION

According to one of its aspects the invention provides a method of feeding material for processing into a roll gap in a roll mill having lateral gap seals wherein supply of material to the roll gap extends beyond the ends of the rolls outwardly of the roll ends whereby a greater volume flow of material is fed to the end regions of the roll gap than to its central region and the roll ends are subjected to greater stress and wear than the central region.

According to another of its aspects the invention provides a roll mill having lateral gap seal devices pressed against the ends of a pair of rolls, each gap seal device having a flow guide which extends near the roll gap and stops short of the roll ends to guide flow of material into the roll gap from beyond the ends of the rolls outwardly of the roll ends.

The sealing devices of the prior construction referred to earlier in this specification meet their sealing requirements to a satisfactory extent but it has been found that they acted as impact surfaces for the product, which in the vicinity of these devices no longer flowed vertically downwards but instead at an angle, even if a small angle, from the vertical into regions of the roll gap situated away from the roll ends further inwards. The central region of the roll gap received a substantially uniform volume flow of the product, whereas the end regions received less product. The central regions of the rolls were subjected to more stress and became worn to a greater extent than the end regions. The initially uniform distribution of pressure forces along the length of the rolls was gradually destroyed to an increasing extent, and the pressure per unit of surface area increased continually at the ends of the rolls as the centres of the rolls were subjected to increasing wear. The edges of the rolls sometimes broke off, thus causing considerable damage and interruption of working or the edges of the rolls had to be re-ground as a precautionary measure at regular intervals of time (for example every 300 to 500 working hours).

With the method and the roll mill embodying the invention the non-uniform disadvantageous wearing of the rolls can be obviated. By providing a flow path or guide which conducts the flow of product from beyond the sealing planes, the impact surfaces directing the flow of product inwardly are disposed sufficiently far outside the roll ends that the flow of product also flows from the impact surfaces to the roll ends with a volume flow which is greater (in relation to unit length of the roll gap) than the volume flow supplied to the central region of the roll gap. This solution is simple, inexpensive and reliable. In a particularly satisfactory constructional form each gap sealing device has a sealing pin which is arranged at the height of the roll gap and seals the roll gap, and an elongate sealing member (preferably in the form of a sealing wedge) which is arranged above the sealing pin and defines and seals the product throughflow space situated above the roll gap.

In this constructional form the sealing wedge has a recess which extends at least approximately at right angles to the axes of the rolls, and has a depth extending outwards in the axial direction which is appropriately selected with a view to a desired supply of product to the ends of the roll gap. The sealing pin on the other hand has a recess which is constructed as a prolongation of the recess in the sealing wedge and extends into the vicinity of the roll gap. This recess communicates with the sealing wedge recess and forms the aforesaid flow path along with the latter.

The sealing pin can be arranged for displacement in an axial direction and can be applied by hydraulic force towards the rolls and can be lifted by spring force away from the rolls. The sealing wedge can also be arranged to be pivotable and can be pressed by spring force against an abutment surface of the sealing pin in every position thereof.

The recess in the sealing pin extends in the radial direction by a distance, to be decided appropriately in each individual case, above the central plane of the rolls. The recess in the sealing pin can also be deeper in the axial direction than the recess of the sealing wedge.

In operation, the product flows vertically downwards in the central region of the rolls, and in the end regions of the rolls it flows by way of the recesses of the sealing wedges into the recesses of the sealing pins and from here into the end regions of the roll gap.

At the end of the sealing pin which is remote from the rolls a similar recess can be formed as at the end nearest to the rolls. When this latter end is worn out the other end can be used as a replacement part.

In a preferred constructional form of roll mill a hydraulically controlled pressure application device is provided to press the rolls towards one another only when there is flow of product and to disengage them when there is no product; here the axial movement of the sealing pin is coupled hydraulically with the movement of the pressure application device so that the hydraulic pressure at the sealing pin is present or absent at the same time as at the rolls. In this way the result is achieved that when the rolls are pressed towards one another the sealing pin is in its operative position applied against the rolls, and when the rolls are disengaged the sealing pin is in its inoperative position lifted off the rolls. This coupling helps avoid damage to the sealing pin which is in contact with the end surfaces of the rolls when the rolls during their disengagement take up positions in which at least one of their axes forms with the axis of the sealing pin an acute angle other than zero.

Thus by this coupling the sealing pin is in its operative position applied against the rolls only as long as product flow is present and the rolls are pressed against one another. Simultaneously with the disengagement of the rolls the sealing pin is withdrawn, thus avoiding risk of damage by friction against the rolls when angularly displaced.

There may be provided a cylinder fixed relatively to the roll mill housing, a piston displaceable between two end positions, and a pressure chamber between the cylinder and the piston which can have hydraulic pressure fluid admitted into it. When there is operating pressure present in the pressure chamber the piston remains in its internal end position and in the absence of operating pressure it remains in its outer end position. The sealing pin is disposed in an axial bore in the piston where it can be fixed in an adjustable position and depending upon the end positions assumed by the piston takes up its operative position applied against the rolls or its inoperative position lifted away from the rolls.

A plurality of helical springs housed in holes in the cylinder can be arranged so that they press against a flange fast with the piston and exert the desired restoring force to the flange necessary in the absence of operating pressure in the pressure chamber, to restore the piston to its outer end position.

The flange may be secured to the piston by means of a screwthreaded nut screwed on to the piston end, and has a screwthreaded hole extending at right angles to the piston axis. Screwed into this hole is an adjusting screw which extends through the piston wall to adjust or fix the sealing pin in position in the piston bore by a suitably shaped wedge.

Each sealing wedge may be arranged to be pivotable in a vertical plane containing the axes of the sealing pins and may be pressed by spring force against an abutment surface of the corresponding sealing pin in every position thereof. For this purpose a spring-loaded traction device may be provided having a spring supporting pin connected securely to the sealing wedge and extending through the roll housing. The spring supporting pin may at its end have a screwthreaded nut which compresses a compression spring bearing on the housing of the roll mill so that the said spring draws the sealing wedge in the direction away from the rolls and holds it in engagement with the sealing pin. In this way damage to the sealing wedge is also obviated whilst the rolls are disengaged.

SHORT DESCRIPTION OF THE DRAWINGS

In order that the invention may be clearly understood and readily carried into effect a preferred embodiment thereof will now be described by way of example with reference to the accompanying drawings wherein.

DESCRIPTION OF THE PREFERRED EMBODIMENT

Figures 1, 2:
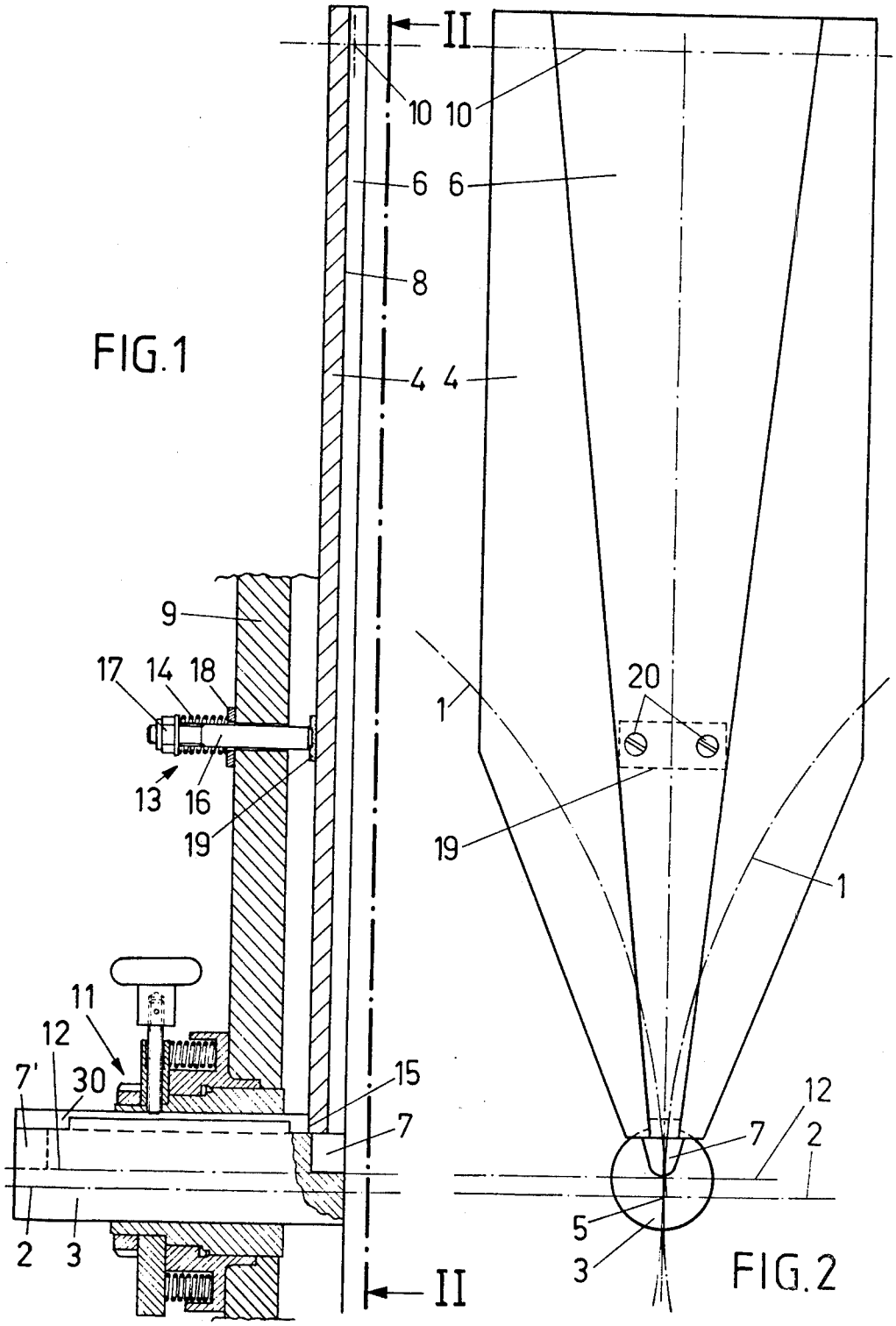
FIG. 1 shows in longitudinal section a gap sealing device, with a sealing pin, a sealing wedge, and a flow path formed therein to guide the flow of product.
FIG. 2 is a view of the sealing pin and the sealing wedge as seen along the line II—II of FIG. 1.

In the drawings, like parts are designated by like reference numerals.

A common feature of all the constructional forms of roller mill embodying the present invention is the flow guide or path of flow of each gap sealing device and which ends in the vicinity of the gap between the rolls and before reaching the gap, and conducts the flow of product from outwardly of the roll ends and then into the roll gap. The material or product to be processed is introduced in such a manner that it is fed from outwardly of the two roll ends, from beyond the roll ends, the end regions of the roll gap being supplied with more volume flow of product than its central region, and thus the roll ends are subjected to more stress and more wear than the central regions of the rolls.

Figure 3:
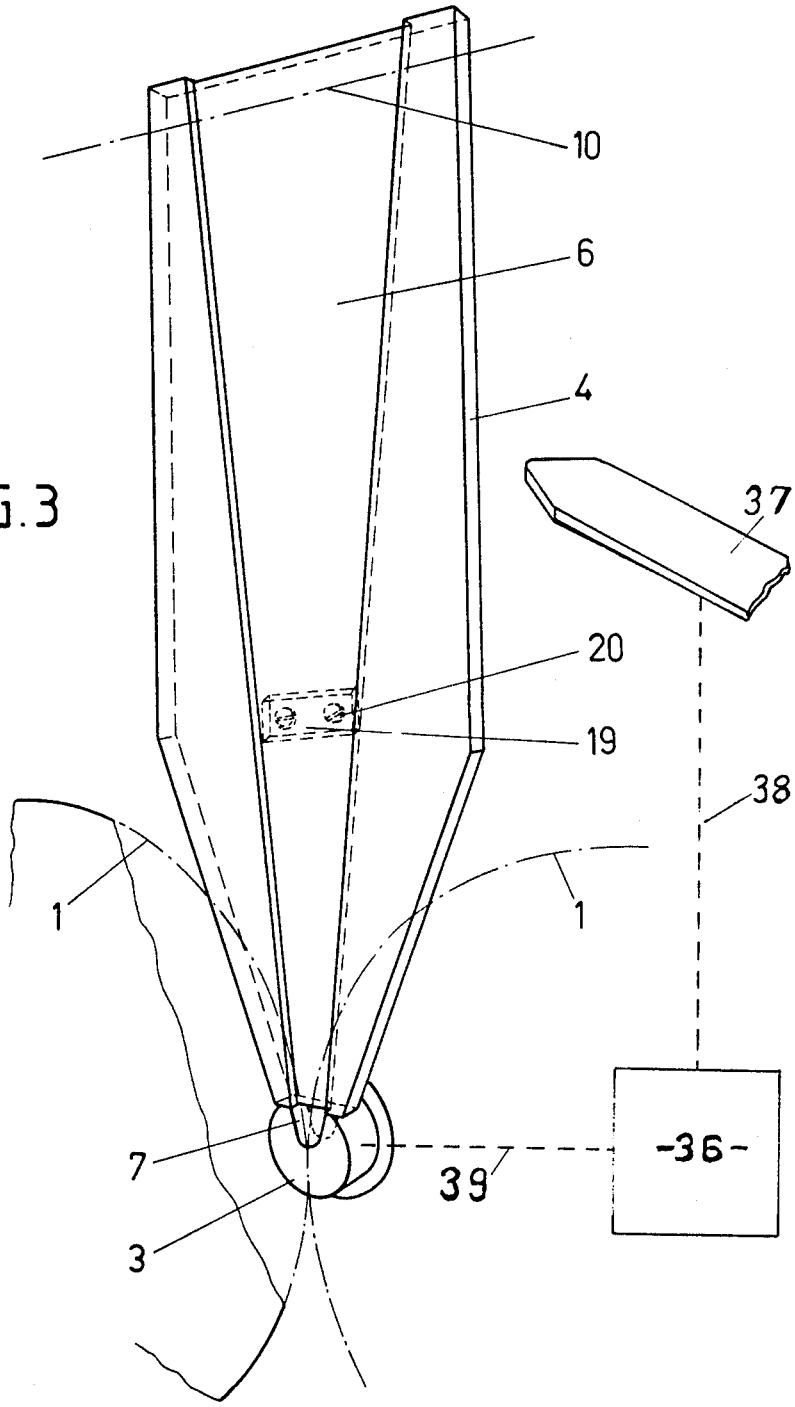
FIG. 3 depicts in perspective the sealing pin and sealing wedge of FIGS. 1 and 2.

A preferred constructional form of the invention includes a gap sealing device constructed as shown in FIGS. 1, 2 and 3 at each of the two ends of the rolls 1 which are indicated with dot-dash lines and whose central plane is designated as 2. Each gap sealing device comprises a sealing pin 3 and an elongate sealing member in the form of a sealing wedge 4 which is disposed above the said pin. The sealing pin 3 is arranged in such a manner relatively to the nip or roll gap 5 situated at the height of the central plane 2 that it seals the roll gap directly, whereas the sealing wedge 4 is in contact with the higher-up regions of the end surfaces of the rolls 1 and thus defines and seals the product throughflow space (not shown) situated above the roll gap 5.

The sealing wedge 4 has a recess 6 which extends vertically and is of rectangular cross-section, decreasing in width gradually in the direction towards the sealing pin 3. The axial depth of the recess 6 is preferably constant and is to be determined with a view to a desired flow of product towards the gap ends.

The sealing pin 3 has a recess 7 which is open in the direction of the roll ends and which is constructed as a prolongation of the recess 6 and extends into the vicinity of the roll gap 5 but ends before reaching the roll gap. The recess 7 communicates with the recess 6 and forms therewith the path of flow which conducts the stream of product from beyond the roll ends and into the roll gap 5. The stream of product in the recess 6 reaches its bottom surface 8 which acts as an impact surface for the product particles and is spaced sufficiently far beyond the roll ends outwardly of the roll ends to allow the product to flow also on to the region of the roll gap near the roll ends by way of the recess 7, with a volume flow which can be varied by appropriate choice of the depth of the recess 6 and can be determined such that it is greater than the volume flow supplied to the central region of the roll gap.

The sealing wedge 4 is mounted to be pivotable about a pivoting axis 10 extending in a vertical plane perpendicular to the axis 12 of the sealing pin 3, at a vertical spacing from the axis 12. A spring-loaded traction device 13 ensures that the sealing wedge 4 is forced by the force of the compression spring 14 into engagement with an abutment surface 15 arranged fixedly relatively to the sealing pin 3, and this engagement is maintained during axial displacement of the sealing pin 3.

The traction device 13 comprises a spring supporting pin 16 which is connected securely to the sealing wedge 4 and which extends through a hole in the roll mill housing 9 and comprises at its ends the screwthreaded nut 17 which compresses the compression spring 14 bearing on the housing 9 by way of the washer 18 such that the spring draws the sealing wedge 4 away from the rolls 1 and keeps it in engagement with the sealing pin 3. The spring supporting pin 16 is connected securely to a rectangular plate 19 by welding, and the plate 19 to the sealing wedge 4 by means of screws 20.

Figure 4:
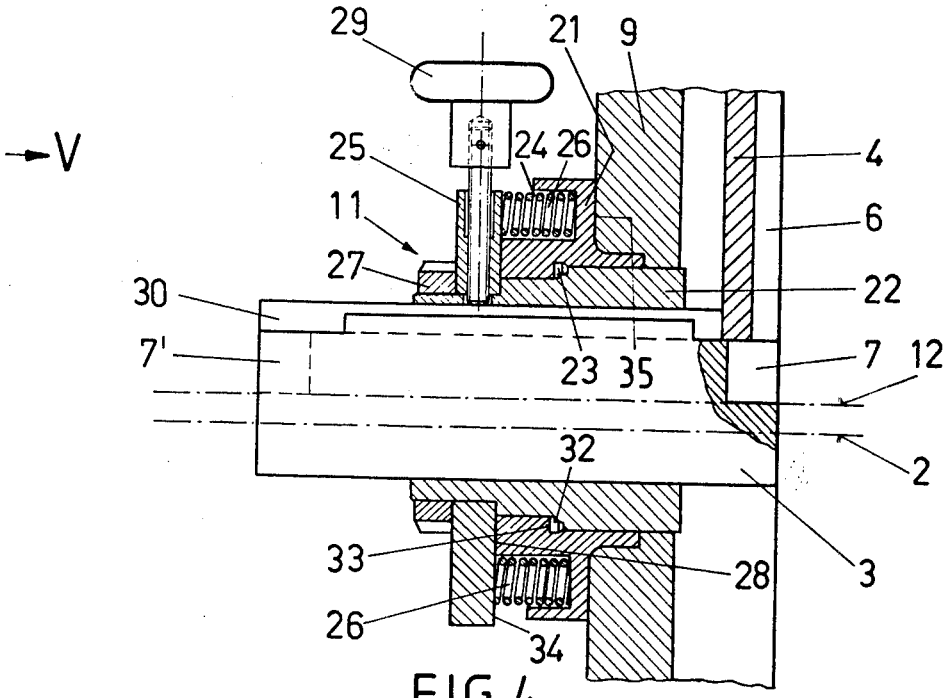
FIG. 4 shows the sealing pin mechanism of the detail 11 of FIG. 1 to a larger scale.
Figure 5:
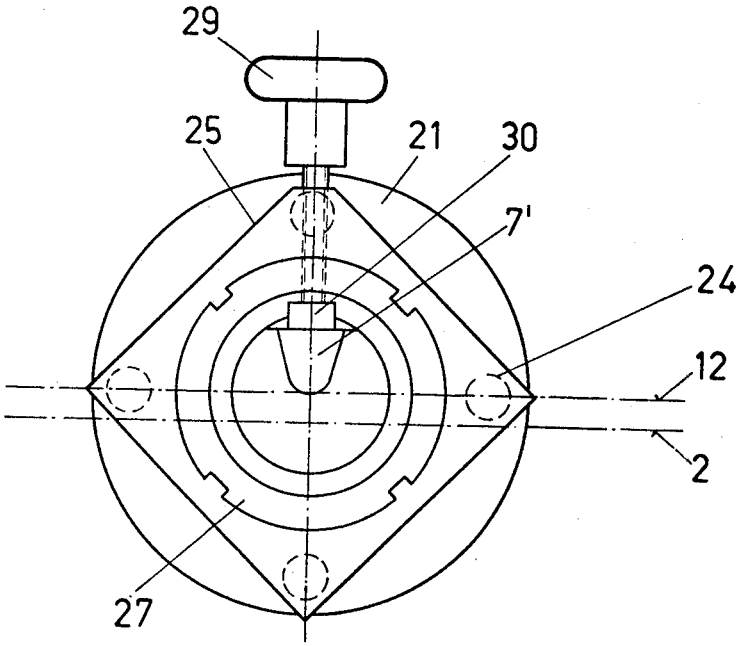
FIG. 5 shows the mechanism of FIG. 4 as seen in the direction of the arrow V of FIG. 4.

The mechanism 11 which is shown in FIGS. 1, 4 and 5 and is constructed for axial displacement of the sealing pin 3 comprises a cylinder 21 which is connected fixedly to the roll mill housing 9, for example being bolted thereto, with a piston 22 which is arranged to be capable of displacement between two end positions in the said cylinder. Between the piston 22 and the cylinder 21 is a pressure chamber 23 which can be acted upon with a hydraulic fluid from a pressure source (not shown).

A flange 25 fitted on to an extension of the piston 22, on the piston end, and secured thereon by means of the nut 27, has a screwthreaded hole which extends at right angles to the piston axis and in which the adjusting screw 29 is screwed. This screw extends through the piston wall and is used for securing the sealing pin 3, arranged to be adjustable independently in the piston bore, by way of the appropriately constructed wedge 30.

A plurality of helical springs 26 are arranged in bores 24 of the cylinder 21 and compressed between the end surfaces of the holes 24 and the internal end face of the flange 25. The helical springs 26 press the piston 22 into its outer end position, in which an extension 32 of piston 22 abuts against an extension 33 of the cylinder bore used as an abutment surface and in which there is a gap between an outer face 28 of the cylinder 21 and the internal surface 34 of the flange 25. By supplying pressure to the pressure chamber 23, the piston 22 can be displaced in opposition to the pressure force of the helical springs 26 in the direction of the end surfaces of the rolls 1 into its inner end position. In this inner end position the inner internal surface 34 of the flange 25 abuts on the outer end face 28 of the cylinder 21 which serves as an abutment surface to limit the displacement of the piston 22 and to serve as a reaction member for the pressure applied to it, thereby relieving or lessening its pressure against the roll ends.

The sealing pin 3 secured in the piston bore moves with the piston 22 and takes up two end positions in accordance with the two end positions of the said piston likewise. In its operative position which corresponds to the inner end position of the piston 22 and is brought about by the presence of pressure in the pressure chamber 23, the sealing pin 3 is in its position applied against the rolls 1. In its inoperative position which corresponds to the outer end position of the piston 22 and is brought about by an absence of pressure in the pressure chamber 23 and the restoring action of the helical springs 26, the sealing pin 3 is in its position lifted away from the rolls 1.

The end of the sealing pin 3 which is remote from the rolls 1 has a recess 7' identical to the recess 7. Consequently, this end can be used as a replacement part when the other end becomes worn.

The mechanism 11 described above for axial displacement of the sealing pin 3 can be used advantageously in conjunction with a roll mill wherein a hydraulically controlled pressure application device 36 (see FIG. 3) is provided for pressing the rolls towards one another only when in operation, i.e. when the product is flowing, and disengaging when there is no stream of product. Flow of product is sensed by sensor 37 which controls pressure application device 36 by way of control line 38. The axial movement of the sealing pin 3 is then advantageously coupled hydraulically with the movement of the pressure application device by way of coupling 39 so that the hydraulic pressure on the piston 22 and thus on the sealing pin 3 is present or absent at the same time as on the rolls 1. Thus when there is a stream of product flowing and the rolls 1 are pressed towards one another, the sealing pin 3 is in its operative position applied against the end surfaces of the rolls, and when the rolls 1 are disengaged, i.e. when there is no stream of product, it is in its operative position lifted away from the end surfaces of the rolls. This avoids damage by friction of the sealing pin 3 in contact with the end surfaces of the rolls during operation when the rolls 1 take up their disengaged position in which at least one of their axes forms an acute angle other than zero with the axis of the sealing pin.

By arranging the sealing wedge 4 to be pivotable about its pivoting axis 10 and because of the action of the traction device 13 which ensures continuous engagement between the sealing wedge 4 and the sealing pin 3, it is also ensured that during the disengagement of the rolls 1, the sealing wedge 4 disengages from the end surfaces of the rolls simultaneously with the sealing pin 3, so that the possibility of the sealing wedge 4 becoming damaged by friction is also obviated.

I claim:

1. Roll mill comprising: a paif of rolls forming a roll gap therebetween, a lateral gap seal device at each end of said pair of rolls, each said gap seal device including a sealing pin and a sealing member, means for pressing said gap seal device against said ends, each gap seal device including a flow guide for guiding the flow of material supplied to said roll gap, each said flow guide extending near said roll gap and stopping short of said roll ends outwardly of said roll ends, each said sealing pin sealing said roll gap in the region of the nip of said roll gap and said sealing member being disposed above said pin to define and seal a path of the flow of said material, said sealing member having an elongate recess extending at least approximately at right angles to the axes of said rolls, and said elongate recess being of a depth in the axial direction determined to guide flow of said material to the region of ends of said gap, said pin having a recess formed as a prolongation of said elongate recess and extending near said roll gap, said two recesses communicating with one another and together forming said flow guide, said guide being adapted to guide flow of material into said roll gap in the regions of said roll ends from beyond the ends of said rolls outwardly of said roll ends.

2. Mill as claimed in claim 1 wherein said sealing pin is mounted for displacement in the direction of its axis, and said mill comprising hydraulic means for applying said pin by hydraulic action against said roll ends, and spring means for lifting said pin by spring action away from said roll ends.

3. Mill as claimed in claim 2 comprising sensor means for sensing the presence and absence of flow of material to said roll gap, a hydraulically controlled pressure application device for pressing said rolls towards one another when there is flow of product and disengaging them in the absence of such flow, said pressure application device being under the control of said sensor means and a hydraulic coupling between said sealing pin and a hydraulic supply for said pressure application device, said hydraulic coupling being so connected that hydraulic pressure is present at or absent from said sealing pin and said rolls at the same time, whereby said sealing pin when said rolls are pressed towards one another is in its position applied against the end surfaces of said rolls, and when said rolls are disengaged is in its position lifted away from the end surfaces of said rolls.

4. Mill as claimed in any one of claims 1, 2 or 3 comprising pivotal mounting means for said sealing member and spring means acting in said sealing member whereby said sealing member is urged against an abutment surface of said sealing pin in every position of said pin.

5. Mill as claimed in claim 2 or claim 3 comprising a cylinder mounted to be stationary relatively to a roll mill housing, a piston mounted for displacement in said cylinder between inner and outer end positions, and a pressure chamber for hydraulic fluid between said cylinder and said piston, said piston having an axial hole, means for fixing said pin in an adjustable position in said hole, the arrangement being such that in the presence of hydraulic operating pressure in said pressure chamber said piston remains in said inner end position and in the absence of operating pressure remains in said outer end position, whereby said pin depending upon the end position assumed by said piston is brought into its operative position applied against said roll ends and in its inoperative position lifted away from said roll ends.

6. Mill as claimed in claim 1 wherein the axial depth of said recess of said sealing pin is greater than the axial depth of said elongate recess of said sealing member.

7. Mill as claimed in claim 1 or claim 6 wherein said recess of said sealing pin ends at a predetermined spacing above the centre plane of said rolls.

8. Mill as claimed in claim 1 wherein said sealing pin has opposite ends each of which has a said recess, said recesses being identical, whereby when one end wears out after being in use pressed against said roll ends said other end can be used as a replacement part by reversal of the pin.

9. Mill as claimed in claim 1 wherein said sealing member is wedge shaped with sides tapering towards said roll gap.

* * * * *

UNITED STATES PATENT AND TRADEMARK OFFICE

CERTIFICATE OF CORRECTION

PATENT NO. : 4,193,555
DATED : March 18, 1980
INVENTOR(S) : Edgar Ruegger

It is certified that error appears in the above-identified patent and that said Letters Patent are hereby corrected as shown below:

Column 2, line 3, delete "the method and";

Column 6, line 31, "paif" should be "pair".

Signed and Sealed this

*Twenty-eighth* Day of *October 1980*

[SEAL]

*Attest:*

SIDNEY A. DIAMOND

*Attesting Officer*

*Commissioner of Patents and Trademarks*